US006776854B2

(12) United States Patent
Bardelmeier et al.

(10) Patent No.: US 6,776,854 B2
(45) Date of Patent: Aug. 17, 2004

(54) PROCESS AND APPARATUS FOR THE PARTIAL THERMOCHEMICAL VACUUM TREATMENT OF METALLIC WORKPIECES

(75) Inventors: Udo Bardelmeier, Herzerg (DE); Peter Minarski, Rodenbach (DE)

(73) Assignee: Vacuheat GmbH, Oberfrohna (DE)

( * ) Notice: Subject to any disclaimer, the term of this patent is extended or adjusted under 35 U.S.C. 154(b) by 0 days.

(21) Appl. No.: 10/080,921

(22) Filed: Feb. 22, 2002

(65) Prior Publication Data

US 2003/0047241 A1 Mar. 13, 2003

(30) Foreign Application Priority Data

Feb. 28, 2001 (DE) ..... 101 09 565

(51) Int. Cl.[7] ..... C23C 8/04

(52) U.S. Cl. ..... 148/213; 148/222; 148/225; 266/44; 266/249; 266/258; 266/275

(58) Field of Search ..... 148/210, 213, 148/222, 225; 266/44, 249, 258, 275

(56) References Cited

U.S. PATENT DOCUMENTS

| | | | | | |
|---|---|---|---|---|---|
| 4,165,243 | A | * | 8/1979 | Sarnes et al. | 419/28 |
| 4,394,529 | A | * | 7/1983 | Gounder | 136/245 |
| 4,572,749 | A | * | 2/1986 | Emerson | 148/206 |
| 4,876,851 | A | * | 10/1989 | Mueller | 60/264 |
| 4,916,401 | A | * | 4/1990 | Bogard et al. | 324/536 |
| 4,978,109 | A | * | 12/1990 | Vigouroux | 266/274 |
| 5,785,771 | A | * | 7/1998 | Mitchell et al. | 148/213 |
| 6,165,597 | A | * | 12/2000 | Williams et al. | 428/212 |
| 6,238,489 | B1 | * | 5/2001 | Lundell | 148/212 |

FOREIGN PATENT DOCUMENTS

| | | |
|---|---|---|
| DE | 29 20 719 A1 | 12/1979 |
| DE | 28 51 983 B2 | 6/1980 |
| DE | 35 02 144 A1 | 8/1985 |
| DE | 41 15 135 C1 | 2/1999 |
| EP | 0 313 888 B2 | 5/1989 |
| EP | 0 695 813 B1 | 2/1996 |
| EP | 0 818 555 A1 | 1/1998 |
| WO | 99/13125 | 3/1999 |
| WO | 00/58531 | 10/2000 |

* cited by examiner

*Primary Examiner*—John P. Sheehan
(74) *Attorney, Agent, or Firm*—Fulbright & Jaworski L.L.P.

(57) ABSTRACT

In the partial thermochemical vacuum treatment of metallic workpieces (1), in particular in the carburization and case hardening of workpieces (1) of case-hardening steel in a carbon-containing atmosphere, surface regions (3, 4, 5, 6) to be treated and surface regions not to be treated abut one another. In order to restrict the surface treatment to the cavities (2) of the workpieces (1) the external surface regions not to be treated are covered by reusable dismountable mould bodies (11) of a temperature-resistant material with at least one mould cavity (15). In this connection the mould body (11) consisting of a lower part (12) and an upper part (13) with openings (12*b*, 13*b*) encloses several workpieces (1) in such a way that no treatment takes place on the external surface regions of the workpieces (1). An electrically conducting mould body (11) is suitable in particular for a thermochemical treatment under the action of a plasma. Graphite or CFC is used as material for the mould bodies (11). In such a mould body the workpieces can be subjected before the carburization to a heating procedure, as well after the carburization to procedures such as diffusion, gas quenching and optionally further treatments such as deep cooling and/or annealing.

38 Claims, 4 Drawing Sheets

Figure 2:
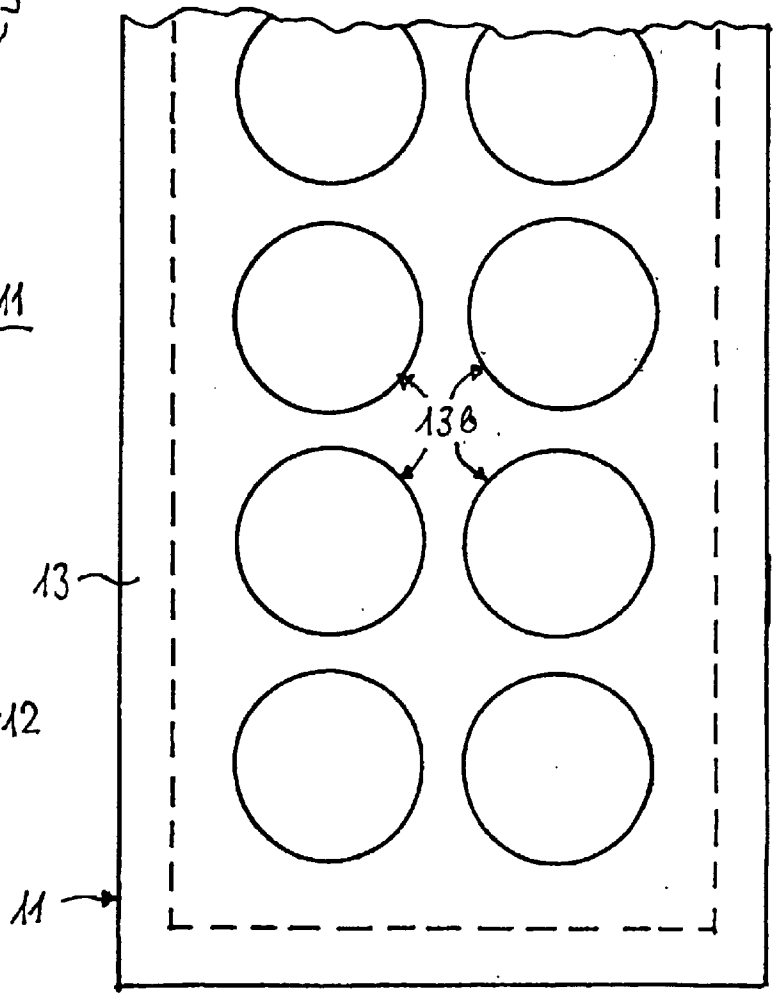

FIG. 3
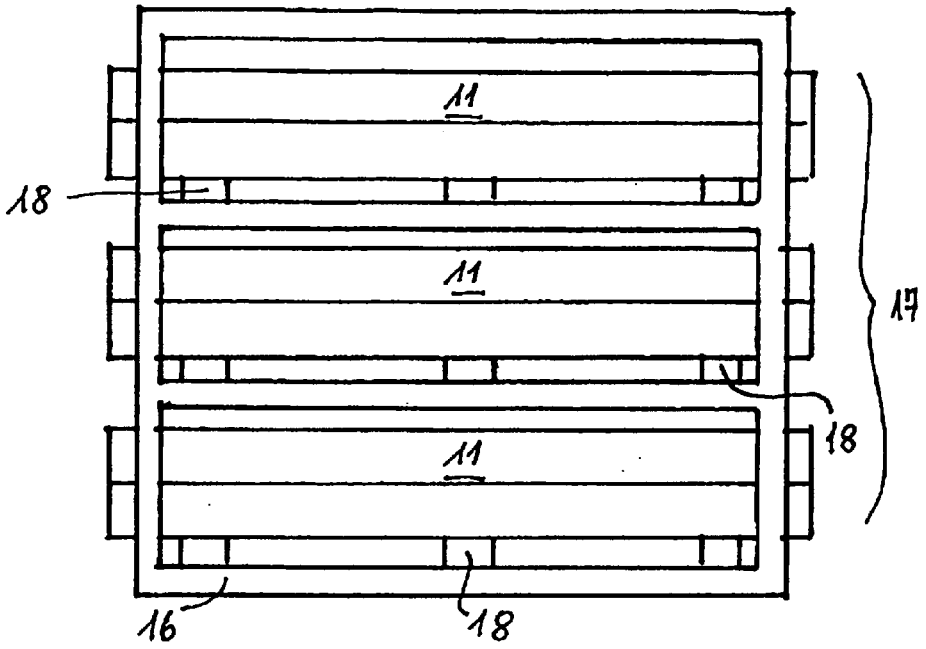
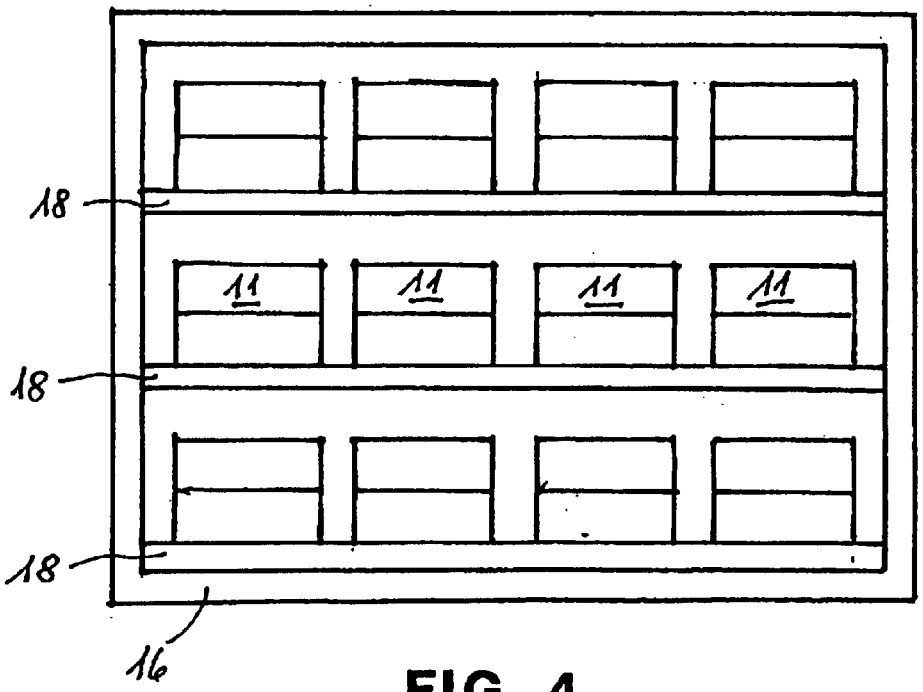
FIG. 4

PROCESS AND APPARATUS FOR THE PARTIAL THERMOCHEMICAL VACUUM TREATMENT OF METALLIC WORKPIECES

The present invention relates to a process for the partial thermochemical vacuum treatment of metallic workpieces.

The thermochemical treatment of workpieces of metals in a gaseous atmosphere of decomposable carbon compounds and/or nitrogen compounds, optionally mixed with other gases, for example inert gases and/or hydrogen is known. For example, DE 41 15 135 C1 describes a process for the treatment of, inter alia, hollow bodies such as injection nozzles or structural parts with bores that are similarly difficult to access. In this process the workpieces are loaded as loose items without any particular arrangement or alignment in the batch receiver. As a result the bore treatment depth is difficult to control, the external surfaces of the workpieces being preferentially treated. If the external surfaces are to be subsequently machined, this becomes difficult or impossible, since after the machining a hardening is out of the question on account of the hardening distortion.

EP 0 818 555 A1 too is concerned with the carburization of hollow bodies with blind holes, though here too the carburization preferentially takes place on the external surface of the hollow bodies.

EP 0 695 813 A2 discloses the use of a plasma with a pulsed voltage of between 200 and 2000 volts for the carburization. Here too however the total external surface of the workpieces is always carburized.

The Applicants' in-house publication "Vakuumgestützte Kohlungsverfahren mit Hochdruck-Gasabschreckung", ["Vacuum-Assisted Carburization Processes with High Pressure Gas Quenching"] W2004d/9.97/2000/St., discloses complete process sequences both in a single-chamber vacuum furnace as well as in a multi-chamber through flow unit. The treatment of the external surfaces of drive/transmission parts such as gearwheels and shafts is described in particular. EP 0 313 888 B2 specifically relates to high pressure gas quenching for the hardening of steel workpieces.

It is also known to carburize workpieces partially in conventional gas carburization by "sealing" with a covering paste those external surface regions that are not to be hardened. Such covering pastes are however not suitable either for vacuum processes or for plasma processes since the covering pastes are unable to withstand the ion bombardment of the plasma. Attempts have also already been made mechanically to cover screw threads by encapsulation or plugging, but in this case also "subcreepage" of the coverings readily occurs due to the different expansions involved, which often can be eliminated only with difficulty and resulting in damage. Also, the threads that are thermally co-treated are no longer dimensionally accurate after the treatment.

It is known from DE 29 20 719 A1 to carburize in a zone-like manner individual annular workpieces such as gearwheels, coupling parts, running rings for roller bearings and the like so that the zones that are not to be carburized are screened by means of reusable sheathings against the carburization gas. This is achieved for example by covering the front faces of the workpieces with disc-shaped moulded parts of metal or briquetted metal powder that engage via annular flanges partially in the bores of the workpieces, and that are stepped or have an annular groove in order to protect the ends of the workpieces. In each case the largest proportions of the internal and also of the external surface regions are exposed to the carburization gas. Due to the carburization and hardening of the external surfaces a subsequent mechanical treatment, e.g. thread cutting, is made difficult. Although a continuous fabrication involving placing the workpieces on a porous conveyor belt and transportation through a throughput furnace are in fact disclosed, nevertheless this always involves the treatment of individual parts. Injection parts for engines and the non-carburization of the external surfaces of these parts are not disclosed.

It is known from WO 00/58531 A1 when coating workpieces with aluminium and/or chromium and compounds thereof to protect partial regions of the workpieces, for example the seat or roots of turbine blades, against the influence of the coating material by providing these partial regions with reusable masks or caps comprising ceramic components that do not react with the workpieces. However, the "masking" of individual workpieces and the coating of external surfaces of the said workpieces are always involved. Injection parts for engines are not disclosed, and in particular the non-carburization of all external surfaces of these parts is not mentioned.

Also, it is known from WO 99/13125 to protect a partial length, i.e. the end of tubular workpieces, for example drill elements, against a thermochemical surface treatment by providing the end of the workpiece with a cap that screens the aforesaid partial length against the influence of the thermochemical surface treatment. The largest part of the external surfaces is however subjected to the thermochemical treatment. Here too it is the masking of the ends of individual workpieces that is described however. Injection parts for engines are not disclosed.

From DE 35 02 144 A1 it is known to protect the internal surfaces of annular workpieces comprising plane front surfaces such as slitted piston rings against a nitriding treatment by protecting these internal surfaces with for example a coating of copper, nickel, chromium or tin. By axially arranging in rows and congruently tensioning the front faces of several workpieces against one another on a carrier it can also be achieved that only the cylindrical external surfaces are subjected to the nitriding treatment. This is the exact opposite of the invention, in which all external surfaces are to be protected against a thermochemical treatment. The process is neither intended nor suitable for workpieces other than annular workpieces that can be mounted on one another in a plane-parallel manner.

From DE 28 51 983 B2 it is known in the carburization of hollow bodies with different wall thicknesses, such as for example in the case of nozzles for diesel engines, to encase the surface regions of the thin-walled sections in jackets, in which a carburization process takes place at a lesser intensity than on the remaining surface regions, in order to avoid a so-called "through-carburization" and an embrittlement. This also applies to the embodiment in which several thin-walled sections of the nozzles are introduced through bores into a common, box-shaped cavity. For all embodiments it is true however that all surface regions, i.e. also the external surfaces of the workpieces, are to be carburized, and that the surroundings of both the thick-walled and also the thin-walled sections of the hollow bodies participate in a mutually throttled manner, for example via the nozzle bores themselves, in the periodic gaseous exchange in a vacuum furnace. The carburization and subsequent hardening of the external surfaces is extremely disadvantageous for a subsequent metal-cutting machining of the workpieces.

None of the aforementioned publications deals with the following problem:

1. It is difficult if not impossible to cover irregular and/or rough surfaces that have been formed for example by casting or forging processes against the penetration of for example carburization gases.

2. On heating to the conventional temperatures for gaseous treatments, which are carried out at 900° C. and above, the covering effect may be reduced or even destroyed by heat distortion, different expansions, etc.
3. Thin-walled extensions of otherwise thick-walled workpieces tend to undergo considerably more severe embrittlement.
4. With the partial covering of workpieces, the boundary between treated and untreated surface regions may be displaced during the treatment as a result of different thermal expansions.
5. Workpieces of relatively large batches, in particular in a mass production run, are exposed to identical process parameters in all predetermined surface regions.

The object of the invention is accordingly to provide a process of the generic type described in the introduction, by means of which several workpieces or batches comprising many workpieces are subjected partially, i.e. only on precisely predetermined internal surface regions, in particular in specific cavities of workpieces, to accurately predetermined process parameters that are at least largely identical from workpiece to workpiece and are reproducible over many treatment cycles. The important point therefore is not only partially to treat the workpieces of a particular batch in a uniform manner, but also the workpiece or workpieces of subsequent batches.

The aforementioned object is solved with the process and apparatus according to the present invention.

The aforementioned object is fully solved by means of the invention, i.e. a process and an apparatus of the generic type described in the introduction are comprehensively improved in that, by means of the process, several workpieces or batches comprising many workpieces can be partially thermochemically treated, i.e. only on accurately defined surface regions in cavities of workpieces. This treatment is effected with precisely predetermined process parameters that are at least largely identical from workpiece to workpiece and that are reproducible over many treatment cycles. The important point in particular is not only to treat the workpieces of a specific batch uniformly and partially in a defined manner, but also the workpieces of subsequent batches, for example in continuous or quasi-continuous processes.

The essence of the invention is accordingly not to treat thermochemically, for example carburize, the external surface of the workpieces, but instead to ensure, wholly or partially, the thermochemical treatment of the internal surfaces.

The invention consists as it were in a reversal of the conventional procedure: it is no longer the largest part of the workpiece surface that is subjected to the thermochemical gaseous treatment, in which relatively small partial regions of the surface(s) are screened and/or insulated against the gaseous treatment, but instead the whole external workpiece surface, except for the internal regions to be treated, are protected against the action of gas by means of the mould body according to the invention. In this connection it is also not absolutely necessary for the mould body according to the invention to surround the workpieces in a gap-free and joint-free manner in a complementary shaping process, but instead it is sufficient to seal, for example in the treatment of the internal space of hollow workpieces, the aforementioned mould body against the ends of the workpieces, optionally with the interpositioning of sleeves, and to leave free several mould cavities between the sealing points in the interior of the mould body that enclose the workpieces and in which no gaseous treatment can take place.

In this way it is possible to treat thermochemically at accurately defined points workpieces of virtually any geometry and/or with irregular and/or rough surfaces that have been formed for example by casting or forging processes, and when heating to the conventional temperatures for gaseous treatments, which are carried out at temperatures of 800° C. and above, to reduce or wholly exclude the influences of a thermal distortion, different expansions, etc., on the covering effect. Thin-walled extensions of otherwise thick-walled workpieces are cooled in a more uniform manner and thereby achieve a more favourable internal stress state. The boundaries between treated and untreated surface regions are no longer displaced by different thermal expansions during the treatment. In particular workpieces of relatively large batches are also exposed to identical process parameters in all predetermined surface regions.

The use according to the invention of the mould bodies enclosing the workpieces and the mould bodies per se according to the invention, which form housings as it were and may also be identified as containers, boxes or the like, enables the latter after they have been loaded with the workpieces not only to be transported into and through a treatment plant involving several process stages, but also surprisingly enables the very large range of treatments occurring in practice to be performed, such as heating, carburization (or nitridation), diffusion, quenching and post-treatment in other units (e.g. deep cooling and annealing) without the individual workpieces having to be "unpacked" and reloaded. This surprising effect applies in particular to the case of high-pressure gas quenching that is carried out in just a few seconds, as is described for example in EP 0 313 888 B2 and in the company literature of the same Applicants mentioned in the introduction.

Thermochemical gaseous treatment may comprise not only a reduced pressure gaseous treatment without plasma excitation at pressures of up to 30,000 Pa, in which the mould bodies and optionally also the interconnected sleeve members may consist of an electrically non-conducting material such as a ceramic material. Rather, it is in particular also possible to employ plasma treatment processes in which the mould bodies may in this case preferably consist of an electrically conducting material, preferably graphite, so that the mould bodies serve as electrode (cathode) for the plasma excitation. Further details and advantages may be found in the detailed description.

The mold bodies are made of carbon fiber composite (CFC).

Within the scope of further developments of the process according to the invention it is particularly advantageous to employ the following features, either individually or in combination:

- in each case at least one surface region of the cavity of the workpiece is screened by means of an inserted sleeve against the thermochemical treatment, whereas at least one further surface region of the cavity is subjected to the thermochemical treatment,
- the thermochemical treatment is carried out under the action of a plasma and the mould body consists of an electrically conducting material,
- a mould body is used having a plurality of mould cavities for accommodating in each case one workpiece,
- the mould body is formed as a housing with an upper part and at least the upper part has openings that communicate with the cavities in the workpieces and through which the carbon-containing atmosphere enters the workpieces,
- sleeves are employed between the surface regions of the workpieces not to be treated and the mould body for the purposes of sealing, a plurality of mould bodies are combined to form a batch, the process is carried out in the vacuum range between 10 Pa and 3000 Pa, preferably between 50 Pa and 1000 Pa, the process is carried out with plasma voltages between 200 and 2000 volts, preferably between 300 and 1000 volts, the plasma is employed as pulses, in which preferably the connection times are selected between 10 and 200 $\mu$s and the pause times between 10 and 500 $\mu$s, at least one hydrocarbon from the group comprising methane, ethane, propane and acetylene is selected as carbon-containing gas, at least one gas from the group comprising argon, nitrogen and hydrogen is added to the carbon-containing gas, the proportion of the at least one hydrocarbon being chosen between 10 and 90% by volume, graphite or CFC is used as material for the mould bodies, especially if a material is used for the mould bodies that does not exhibit any deformation phenomena at least up to a temperature of 1050° C., preferably up to 1200° C., the plasma-side ends of the at least one mould cavity of the mould bodies opposite the respective workpiece are formed in a plasma-tight manner, and/or the workpieces within the mould body are subjected a) before the carburization to a heating process, b) after the carburization to a diffusion process, c) after the diffusion process to a high pressure gas quenching, d) after the high pressure gas quenching to a further treatment involving deep cooling and annealing.

Within the scope of further modifications of the apparatus according to the invention it is particularly advantageous to employ the following features, either individually or in combination:

the mould body is formed as a housing and consists of an electrically conducting material and the workpieces can be enclosed in the mould cavity in such a way that when employing plasma no plasma is formed between the mould body and the workpieces, the mould body for the treatment of workpieces with cavities that are subjected to a thermochemical vacuum treatment has several openings that communicate with the cavities of the in each case associated workpieces, the mould body is formed as a housing with an upper part and at least the upper part has several openings that communicate with the cavities in the in each case associated workpieces, the mould body has a lower part that has several openings and the axes of the openings in the upper part and in the lower part coincide, a separating groove running along the circumference and that permits a telescopic movement between the lower part and upper part is arranged between the said lower part and upper part, the plasma-side ends of the openings in the mould body opposite the respective workpiece are formed in a plasma-tight manner, sleeves are provided that can be inserted between the workpiece and the lower part on the one hand and the workpiece and the upper part on the other hand, and which match the workpiece in such a way that surface regions of the workpieces not being treated are excluded from the thermochemical treatment, a plurality of mould bodies are combined by a transporting frame to form a batch, in particular the transporting frame has crosspieces for installing mould bodies in a spaced-apart manner adjacent to one another and on top of one another, graphite or CFC is used as material for the mould bodies, and in particular a material is used for the mould bodies that does not exhibit any deformation phenomena at least up to a temperature of 1050° C., preferably up to 1200° C., and/or the mould body is arranged within an evacuable chamber with an inlet for at least one hydrocarbon and is connected as a cathode for the formation of a plasma.

An embodiment of the subject matter of the invention and its mode of action are described in more detail hereinafter with the aid of FIGS. 1 to 6 in conjunction with a thermochemical plasma treatment.

Figure 1:
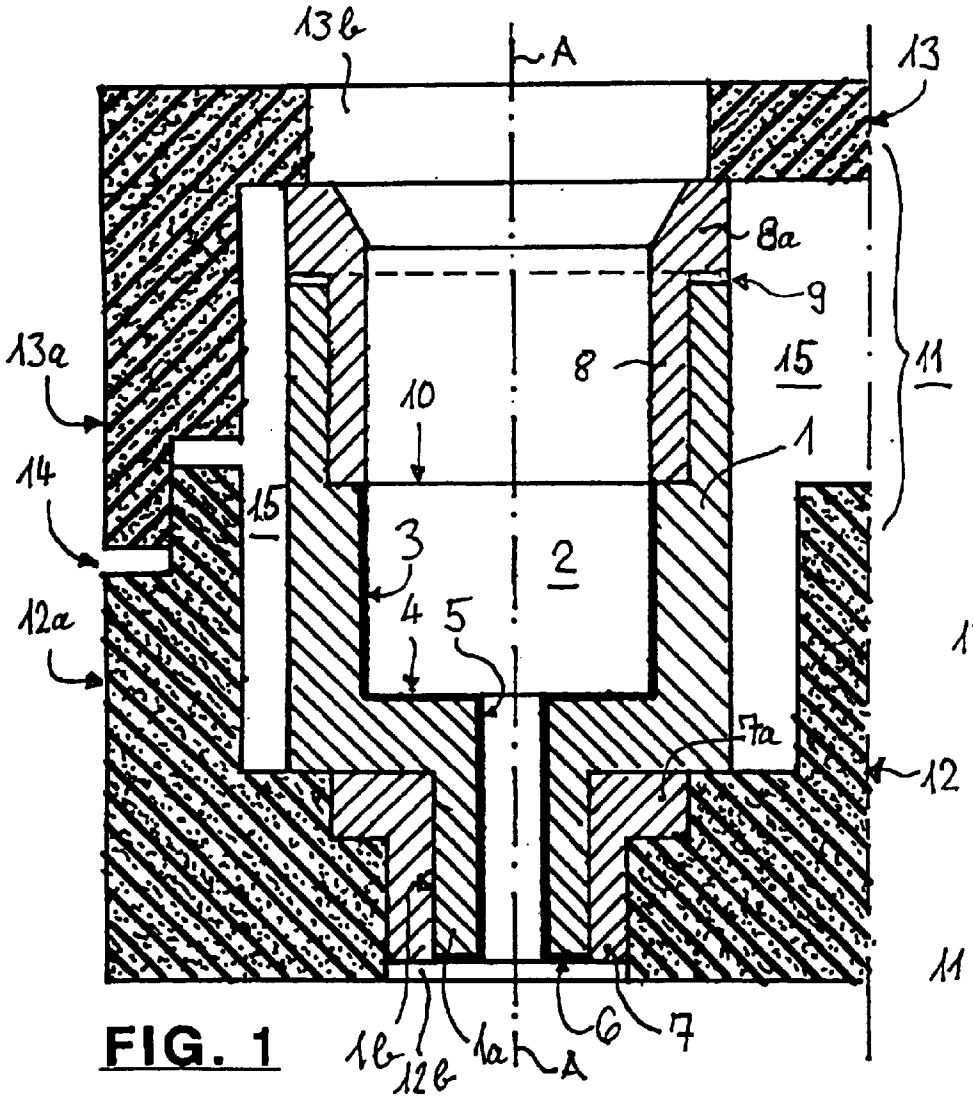
Figure 5:
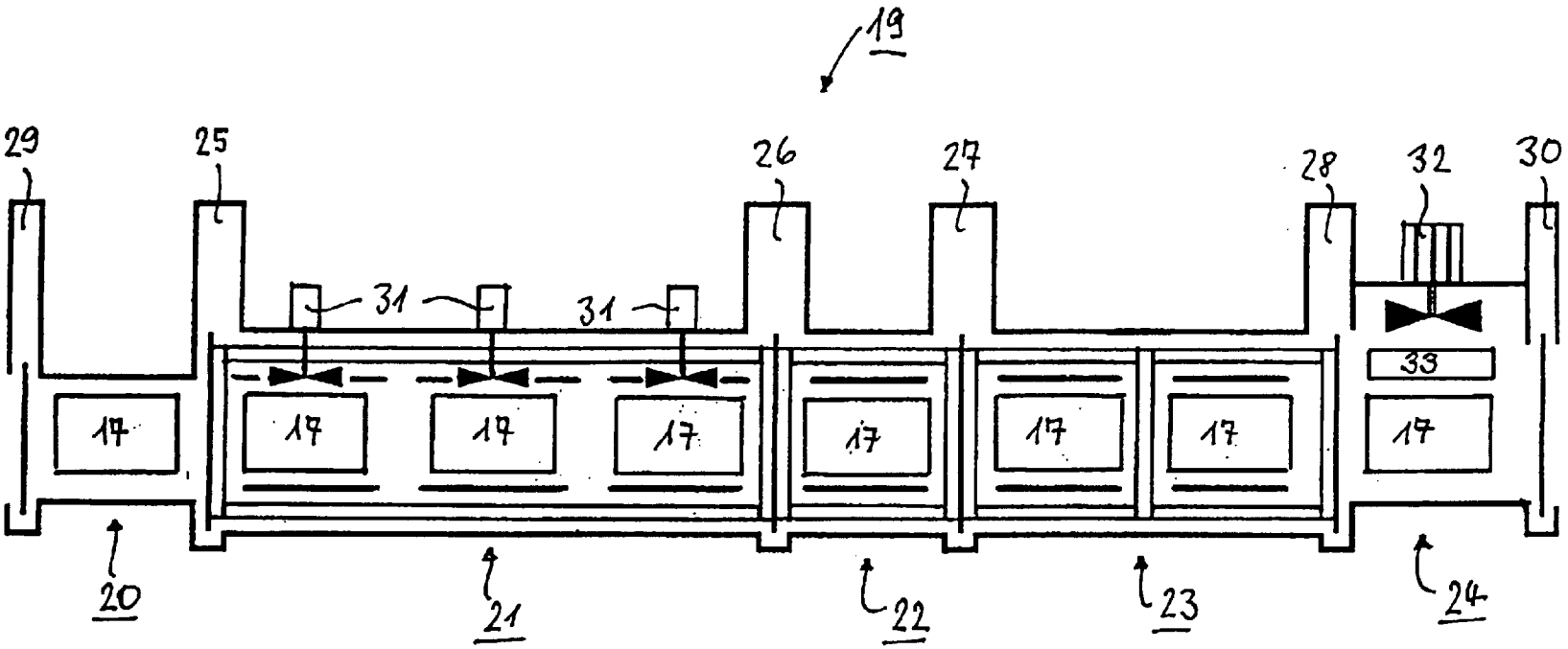
Figure 6:
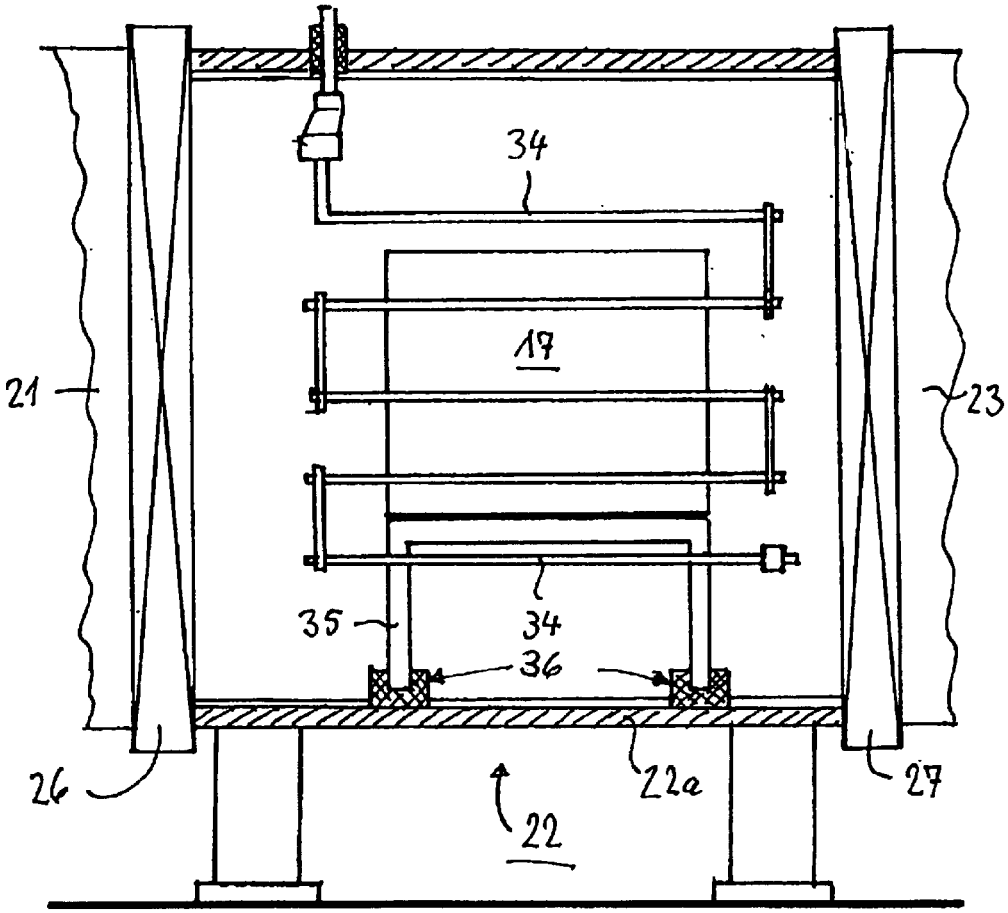

In the drawings:

FIG. 1 is a half vertical section through one of the workpieces within the mould body transverse to its longitudinal axis, FIG. 2 is a plan view of one end of a mould body for a plurality of workpieces on a reduced scale, FIG. 3 is a side view of a transporting frame with a batch consisting of twelve mould bodies in three levels, FIG. 4 is a further side view of the object according to FIG. 3 viewed in a direction rotated by 90°, FIG. 5 is a longitudinal section through a throughflow unit for the treatment of batches according to FIGS. 3 and 4 in a highly schematic representation, and FIG. 6 is a portion of FIG. 5 on an enlarged scale and with additional details.

A sleeve-shaped workpiece 1 with an axis A—A is shown in FIG. 1, which has a cavity 2 in the form of a stepped bore whose highly bordered inner cylindrical surface regions 3, 4 and 5 as well as the surface region 6, which is an annular front face, are to be carburized, the other surface regions remaining uncarburized. The raised surface regions 3, 4, 5 and 6 are subjected during the treatment to a plasma of a carbon-containing atmosphere.

The workpiece 1 has a tubular extension 1*a* whose outer surface 1*b* has to be protected against the plasma bombardment. This protection is afforded by a sleeve 7 with a flange 7*a* that encloses the extension 1*a* with the smallest possible play in order to prevent the penetration of the plasma. The sleeve 7 may consist of a metallic material as well as of a non-metal that does not react with the workpiece 1. In the upper end of the workpiece 1, whose cavity 2 has a larger diameter at this point, is inserted a further sleeve 8 with a flange 8*a* that leaves an annular gap 9 free opposite the workpiece in order to compensate for tolerances and/or thermal expansions. It is important that no plasma can penetrate a separating groove 10. Also, the sleeve 8 may likewise consist of a metallic material but also of a non-metal that does not react with the workpiece 1. The workpiece 1 and the sleeves 7 and 8 form as it were a rotationally symmetrical stack that has the function described hereinafter. The rotational symmetry is however not essential.

The aforedescribed stack is inserted in a two-part mould body 11 consisting of a lower part 12 and an upper part 13 whose sides 12*a* and 13*a* overlap in a plasma-tight and telescopic manner at a Z-shaped separating groove 14. The lower part 12 has an opening 12*b* into which the sleeve 7 is inserted, again in a plasma-tight manner, and the upper part 13 has an opening 13*b* whose edge overlaps the flange 8*a* of the sleeve 8, again in a plasma-tight manner. The axes of the openings 12*a* and 13*a* coincide with one another. In this way the upper part 13, which acts as a cover, is supported on the stack consisting of the workpiece 1 and the sleeves 7 and 8.

The clearly shown vertical play at the separating groove 14 serves to compensate tolerances and/or thermal expansions. As a result no plasma can form in the mould cavity 15 enclosing the workpiece 1. The mould cavity 15 can tightly surround any workpiece, but can also form free spaces around the workpiece provided only that no plasma can penetrate between the openings 12*a* and 13*a* and the workpiece and/or the sleeves 7 and 8. Free spaces favour the insertion of workpieces having different geometries.

The mould body 11 preferably consists of graphite or CFC, which has the requisite properties as regards durability, reusability, temperature resistance, thermal coefficient of expansion and electrical conductivity. The sleeves 7 and 8 are not absolutely essential, but may be advantageous if the mould body 11 consists of graphite, which could favour carburization at undesired places on the workpiece. Furthermore, the replaceable sleeves 7 and/or 8 may serve as adapters for the insertion of workpieces having different geometries.

It is understood that the arrangement according to FIG. 1 may be repeated as often as desired within the mould body 11, which is illustrated with the aid of FIG. 2.

FIG. 2 is a plan view of one end of such a mould body 11 on a reduced scale, and more specifically a plan view of the upper part 13 with a plurality of such openings 13*b* but without workpieces; in use the number of workpieces corresponds to the number of openings 13*b*. The mould cavity 15, which is also present in this case, may be closed around each workpiece, but may also be continuous around some or all the workpieces. If such a mould body 11 is to be only partially filled with workpieces, then it is sufficient to seal the openings 12*a* and 13*a* otherwise remaining free by welsh plugs.

FIGS. 3 and 4 show side views of a transporting frame 16 with a batch 17 consisting of twelve mould bodies 11 in three levels. The transporting frame 16 consists of a cuboid frame structure whose individual frame elements coincide with the edges of the cuboid. A plurality of horizontal crosspieces 18 on which the mould bodies 11 rest extend through the frame structure.

FIG. 5 shows a longitudinal section through a throughflow unit 19 for the treatment of batches 17 according to FIGS. 3 and 4 in a highly schematic representation. The throughflow unit 19 has arranged in rows—counting in the working direction—a total of five chambers 20, 21, 22, 23 and 24 that are separated or can be separated from one another by inner sluice slide valves 25, 26, 27 and 28. An inflow sluice slide valve 29 is located at the inlet of the throughflow unit 19 and an outflow sluice slide valve 30 is located at the outlet thereof. Via the slide valves 28 and 30 the last chamber 24, namely the quenching chamber, simultaneously serves as an outflow sluice chamber.

The chamber 20 is an inflow sluice chamber and has a loading bay for a batch 17. The chamber 21 is a heating chamber and has loading bays for three batches 17 as well as three circulating fans 31. The chamber 22 is a carburization chamber and has a loading bay for a batch 17. The chamber 23 is a diffusion chamber and has loading bays for two batches 17. The chamber 24 is a cold high pressure quenching chamber and has a loading bay for a batch 17, a circulating fan 32, and a gas cooler 33. The number of batches 17 in the chambers 21, 22, 23 and 24 and the residence times and chamber lengths predetermined thereby are adjusted to a specific cycle time of for example 30 minutes.

The heating process in the chamber 21 thus takes 90 minutes, and during this time the batches 17 advance in a programmed manner every 30 minutes. The carburization process in the chamber 22 thus lasts a maximum of 30 minutes, but can be discontinued within this time and after reaching the preset carburization level by disconnecting the voltage supply for the plasma generation. The diffusion process in the chamber 23 thus takes 60 minutes, and during this time the batches 17 advance in a programmed manner every 30 minutes. The quenching process in the chamber 24 thus takes at most 30 minutes, but can be terminated prematurely according to experience. The batches 17 are transported by means of a walking beam system known per se, which however for the sake of simplicity is not shown.

During all the treatment procedures the workpieces 1 remain in the mould bodies and therefore do not have to be "unpacked" and reloaded. It has surprisingly been found that the encapsulation in the mould bodies also does not have any negative influence on processes other than the carburization, in particular on the high pressure gas quenching. Rather, the workpieces may also remain in the mould bodies after the end of the quenching and for further post-treatments, such as for example in a further unit for deep cooling by gaseous nitrogen at a temperature of down to −150° C. for the residual transformation of the austenite and subsequent annealing.

FIG. 6 shows a section of FIG. 5 on an enlarged scale and with additional details. An arrangement of heating elements 34 mounted on both sides of the transporting path, and a support 35 that rests on isolators 36, are shown in the carburization chamber 22. The negative pole of a pulsed voltage source for generation of a plasma is connected (not shown) to this support, whereas the chamber walls 22*a* are at earth potential. Also, the gas inlet lines for the various possible hydrocarbons such as methane, ethane, propane and acetylene and optionally inert gases such as nitrogen and argon and optionally a reducing gas such as hydrogen as well as mixtures of these gases are not shown, nor are the suction connection pieces of a vacuum pump unit.

EXAMPLE

In a vacuum throughflow unit 19 according to FIGS. 5 and 6 batches 17 were thermochemically treated in the arrangement and layout illustrated in FIGS. 1 to 3. The cuboid mould bodies 11 according to FIGS. 1 and 2 consisted of graphite and had external dimensions L=500 mm, W=100 mm and H=60 mm. The spatial distribution of the sleeve-shaped workpieces 1, which consisted of a conventional case-hardening steel, and the sleeves 7 and 8 corresponded to FIG. 1 in conjunction with FIG. 2. The cyclical operation of the unit is described in more detail above. The cycle time of the unit was 30 minutes. The gaseous atmosphere in the chambers 21, 22 and 23 consisted of 50 vol. % methane, 25 vol. % argon and 25 vol. % hydrogen. The pressures were about 100 Pa.

The batches 17 were charged individually via the chamber 20 and were first of all heated in the chamber 21 within 90 minutes by means of the heating elements 34 to a temperature of 960° C. The in each case last of the batches 17 was then transported to the chamber 22 for carburization, likewise at 960° C., and the voltage supply for this batch 17 was switched on for 20 minutes. The pulsing and/or cyclical voltage was 700 volts.

The carburized batch 17 was then transported to the chamber 23 for the diffusion of the absorbed carbon, likewise at 960° C., in which chamber the batch remained for 60 minutes with a single transfer from the first loading bay to the second loading bay, which had been vacated by the removal of the last batch. The in each case last batch 17 was then transported to the chamber 24, where it was quenched with hardening of the carburized partial regions, taking into account the conventional TTT diagrams. Such a procedure is described very comprehensively in EP 0 313 888 B2, and accordingly further details are not necessary here.

After the subsequent deep cooling with gaseous nitrogen at a temperature of down to −150° C. and the conventional annealing, an HV hardness of more than 700 was measured on the carburized regions of the workpieces 1, and a very uniform hardening depth of 0.7 to 0.8 mm was measured on a micrograph of a polished section. The distortion of the workpiece was within specified tolerances, and the workpieces 1 were absolutely free of cracks. The mould bodies 11 could be reused as often as desired without any signs of distortion.

Were "defined" cavities 2 within a workpiece 1 are described hereinbefore, these are cavities that are accessible to the furnace atmosphere at at least one point from outside during the thermochemical treatment, for example through at least one of the openings 12*b* and/or 13*b* associated in each case with a workpiece.

The surface region 6 to be treated, i.e. an annular-shaped front face, is counted as one of the internal surface regions 3, 4, 5 since the said surface region 6 communicates with the surface region 5, of a bore wall of the workpiece 11.

| List of reference numerals: | |
|---|---|
| 1 | Workpiece |
| 1a | Extension |
| 1b | Outer surface |
| 2 | Cavity |
| 3 | Surface region |
| 4 | Surface region |
| 5 | Surface region |
| 6 | Surface region |
| 7 | Sleeve |
| 7a | Flange |
| 8 | Sleeve |
| 8a | Flange |
| 9 | Annular gap |
| 10 | Separating groove |
| 11 | Mould body |
| 12 | Lower part |
| 12a | Side |
| 12b | Opening |
| 13 | Upper part |
| 13a | Side |
| 13b | Opening |
| 14 | Separating groove |
| 15 | Mould cavity |
| 16 | Transporting frame |
| 17 | Batch(es) |
| 18 | Crosspieces |
| 19 | Throughflow unit |
| 20 | Chamber |
| 21 | Chamber |
| 22 | Chamber |
| 22a | Chamber walls |
| 23 | Chamber |
| 24 | Chamber |
| 25 | Sluice slide valve |
| 26 | Sluice slide valve |
| 27 | Sluice slide valve |
| 28 | Sluice slide valve |
| 29 | Inflow sluice slide valve |
| 30 | Outflow sluice slide valve |
| 31 | Circulating fan |
| 32 | Circulating fan |
| 33 | Gas cooler |
| 34 | Heating elements |
| 35 | Supports |

-continued

| List of reference numerals: | |
|---|---|
| 36 | Isolators |
| A—A | axis |

What is claimed is:

1. A process for the partial thermochemical vacuum treatment of metallic workpieces comprising:

simultaneously vacuum treating several metallic workpieces having defined cavities and a region to be treated and an external surface region that is not to be treated, wherein the workpieces are installed in a mold body having at least one mold cavity and several openings trough which a carbon containing atmosphere enters the cavities of the workpieces, in-wherein the workpieces are enclosed in the mold body in such a way that no thermochemical treatment takes place on the external surface and the region to be treated is thermochemically treated, wherein the thermochemical treatment is carried out under the action of a plasma and that the mold body consists of an electrically conducting material.

2. A process according to claim 1, wherein in each case at least one surface region of the cavity of the workpiece is screened by a sleeve that is inserted to protect the screened region of the cavity against a thermochemical treatment, whereas at least one additional surface region of the cavity is subjected to the thermochemical treatment.

3. A process according to claim 1, wherein the metallic workpiece comprises steel and the thermochemical treatment is carburization.

4. A process according to claim 1, wherein a mold body having a plurality of mold cavities receives one workpiece per mold cavity.

5. A process according to claim 1, wherein the mold body is formed as a housing with an upper part and that at least the upper part has openings that communicate with the cavities in the workpieces and through which the carbon-containing atmosphere enters the said workpieces.

6. A process according to claim 1, wherein between the surface regions not being treated of the workpieces and the mold body sleeves are employed for sealing purposes.

7. A process according to claim 1, wherein a plurality of mold bodies are combined to form a batch.

8. A process according to claim 1, wherein the process is carried out in a vacuum range between 10 Pa and 3000 Pa.

9. A process according to claim 2, wherein the process is carried out with plasma voltages of between 200 and 2000 volts.

10. A process according to claim 9, wherein the plasma is used in pulsed form.

11. A process according to claim 10, wherein the connection time is between 10 and 200 $\mu$s and the pause time is between 10 and 500 $\mu$s.

12. A process according to claim 1, wherein the carbon-containing gas is at least one hydrocarbon selected from the group consisting of methane, ethane, propane and acetylene.

13. A process according to claim 12, wherein at least one gas selected from the group consisting of argon, nitrogen and hydrogen is added to the carbon-containing gas wherein, the proportion of the at least one hydrocarbon being chosen between 10 and 90 vol. %.

14. A process according to claim 1, wherein the material for the mold bodies is graphite.

15. A process according to claim 1, wherein a material that does not exhibit any distortion phenomena at a temperature of at least 1050° C. is used as material for the mold bodies.

16. A process according to claim 3, wherein the plasma-side ends of the at least one mold cavity of the mold bodies are formed in a plasma-tight manner opposite the respective workpiece.

17. A process according to claim 1, wherein the workpieces within the mold body are subjected to a heating procedure before the carburization.

18. A process according to claim 1, wherein the workpieces within the mold body are subjected to a diffusion procedure after the carburization.

19. A process according to claim 1, wherein the workpieces within the mold body are subjected to a high pressure gas quenching after the diffusion procedure.

20. A process according to claim 19, wherein the workpieces within the mold body are subjected after the high pressure gas quenching to at least one further treatment from the group consisting of deep cooling and annealing.

21. An apparatus for use in a single-chamber unit or in a multi-chamber throughflow unit for the partial thermochemical vacuum treatment of metallic workpieces comprising at least one reusable mold body that comprises a temperature-resistant material to cover surface regions of a workpiece not to be treated during the treatment of the remaining surface regions, wherein several mold cavities are provided in the mold body for the insertion of several workpieces, wherein the workpieces can be enclosed in the mold cavity in such a way that no thermochemical treatment takes place on the external surfaces of the workpieces; wherein the mold body is formed as a housing and comprises an electrically conducting material and the workpieces can be enclosed in the mold cavity in such a way that when using a plasma no plasma is formed between the mold body and the workpiece.

22. An apparatus according to claim 21, wherein the mold body has several openings that communicate with the cavities of the in each case associated workpieces.

23. An apparatus according to claim 21, wherein the mold body is formed as a housing with an upper part, and that at least the upper part has several openings that communicate with the cavities.

24. An apparatus according to claim 23, wherein the meld body comprises a lower part that has several openings, wherein the axes of the openings in the upper part and in the lower part coincide.

25. An apparatus according to claim 24, wherein between the lower part and upper part of the mold body there is arranged a separating groove running along the circumference, which permits a telescopic movement between the lower part and upper part.

26. An apparatus according to claim 21, wherein the plasma-side ends of openings in the mold body opposite the respective workpiece are formed in a plasma-tight manner.

27. An apparatus according to claim 21, having sleeves that can be inserted between the workpiece and a lower part on the one hand and between the workpiece and an upper part on the other hand, and which match the workpiece in such a way that surface regions of the workpieces not being treated are excluded from the thermochemical treatment.

28. An apparatus according to claim 21, wherein a plurality of mold bodies are combined by means of a transporting frame to form a batch.

29. An apparatus according to claim 28, wherein the transporting frame comprises crosspieces for arranging mold bodies next to one another and on top of one another.

30. An apparatus according to claim 21, wherein the mold body consists of graphite.

31. An apparatus according to claim 21, wherein the mold bodies comprise a material that docs not exhibit any distortion phenomena at a temperature of at least 1050° C.

32. A process according to claim 8, wherein the process is carried out in a vacuum range between 50 Pa and 1000 Pa.

33. A process according to claim 31, wherein the process is carried out with plasma voltages between 300 and 1000 volts.

34. An apparatus according to claim 31, wherein the material does not exhibit any distortion phenomena at a temperature of up to at least 1200° C.

35. A process for the partial thermochemical vacuum treatment of metallic workpieces comprising:

simultaneously vacuum treating several metallic workpieces having defined cavities and a region to be treated and an external surface region that is not to be treated, wherein the workpieces are installed in a mold body baying at least one mold cavity and several openings through which a carbon containing atmosphere enters the cavities of the workpieces, wherein the workpieces are enclosed in the mold body in such a way that no thermochemical treatment takes place on the external surface and the region to be treated is thermochemically treated, wherein the thermochemical treatment is carried out under the action of a plasma and that the mold body consists of an electrically conducting material wherein the mold body is formed as a housing with an upper part and that at least the upper part has openings that communicate with the cavities in the workpieces and through which the carbon-containing atmosphere enters the workpieces, wherein sleeves are positioned between the surface regions of the workpieces not being treated and the mold body.

36. A process according to claim 1, wherein the mold bodies comprise carbon fiber composite.

37. An apparatus according to claim 21, wherein the mold body comprises carbon fiber composite.

38. An apparatus according to claim 21, wherein that the mold body is arranged within an evacuable chamber with an inlet for at least one hydrocarbon and is connected as a cathode for the formation of a plasma.

* * * * *